US006198892B1

(12) United States Patent
Ohara

(10) Patent No.: US 6,198,892 B1
(45) Date of Patent: Mar. 6, 2001

(54) IMAGE FORMING APPARATUS USING ERASE LIGHT

(75) Inventor: Koji Ohara, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/496,610

(22) Filed: Feb. 2, 2000

(30) Foreign Application Priority Data

Feb. 2, 1999 (JP) ..... 11-025391

(51) Int. Cl.[7] ..... G03G 21/00
(52) U.S. Cl. ..... 399/128
(58) Field of Search ..... 399/128, 186, 399/219, 220, 221, 299, 179

(56) References Cited

U.S. PATENT DOCUMENTS 4,008,954 * 2/1977 Ogawa et al. ..... 355/1
4,708,464 * 11/1987 Otsuki et al. ..... 355/45
5,287,147 * 2/1994 Fukasawa et al. ..... 399/211
5,418,384 * 5/1995 Yamana et al. ..... 257/88
6,029,022 * 2/2000 Takase ..... 399/66

FOREIGN PATENT DOCUMENTS 63-116117 * 5/1988 (JP) .
63-180981 * 7/1988 (JP) .
7-219294 8/1995 (JP) .
7-261616 * 10/1995 (JP) .

* cited by examiner

*Primary Examiner*—Robert Beatty
(74) *Attorney, Agent, or Firm*—McDermott, Will & Emery

(57) ABSTRACT

The present invention provides a simplified configuration to an image forming apparatus having a photoconductive member by making use of a waveguide (light propagation) member capable of easily diverging and/or refracting light so that the photoductive member is discharged.

2 Claims, 5 Drawing Sheets

8

IMAGE FORMING APPARATUS USING ERASE LIGHT

RELATED APPLICATION

This application is based on application No. H11-025391 field in Japan, the entire content of which is hereby incorporated by reference.

BACKGROUND OF THE INVENTION

1. Field of the Invention

This invention relates to an image forming apparatus such as a laser beam printer, an electrostatic photocopier, or the like, and more particularly concerns an image forming apparatus which incorporates an improved light eraser for removing electric charges from a photoconductive member.

2. Description of the Related Art

In a typical image forming apparatus such as a laser beam printer and an electrostatic photocopier, an electrostatic latent image is formed on a photoconductive member overlying the outer peripheral surface of a rotating drum, which is then followed by (a) a toner development process in which particles of toner powder are adhered to the photoconductive member, (b) a transfer process in which a toner pattern on the photoconductive member is transferred onto a copy paper sheet, and (c) a fixing process in which the transferred toner pattern is affixed to the copy paper sheet. Thereafter, as preparations for the next image forming process, residual toner powder particles remaining on the photoconductive member are removed therefrom and the surface of the photoconductive member is illuminated with light rays from a light eraser located face to face with the photoconductive member so that residual electric charges remaining in the photoconductive member are optically removed.

A light eraser is required to illuminate light rays across the entire width of a photoconductive member. For the case of a full-color photocopier having a plurality of photoconductive members, it is necessary to illuminate light rays across the entire width of each of the plurality of photoconductive members.

a) FIG. 4 shows a prior art technique (i.e., a light eraser 102) for applying light rays across the entire width of a photoconductive member, wherein a plurality of light-emitting diodes (hereinafter called the LEDs) 104 or a plurality of incandescent electric lamps serving as light sources are mounted on a substrate 103 in a side by side fashion in the axial direction of a photoconductive member 101. However, the problem with the light eraser 102 is that the LEDs 104 are likely to vary in performance, resulting in illuminating the photoconductive member 101 at different quantities of light. Therefore, the photoconductive member 101 cannot uniformly be discharged across its entire length. In order to avoid such a drawback, it has been proposed to employ a light receiving element 105 such as a photosensor for detecting the quantity of light. However, it is practically difficult to measure the quantity of light for each LED 104 because of some constraints such as limitations of space. Additionally, since the number of component parts increases, this will establish limits to improving durability as well as to reducing manufacturing costs.

b) In a full-color photocopier of a tandem type, a plurality of photoconductive members are each provided with a light eraser. Recently, with the downsizing of electrophotographic copiers, the size of photoconductive members is likewise reduced. Accordingly, it is necessary to reduce a space between devices (e.g., cleaners and chargers) mounted in the vicinity of a photoconductive member. It is therefore difficult to achieve the downsizing of photoconductive members when an LED unit as a light eraser is provided to each photoconductive member. The reason is that, when an LED unit is disposed around the periphery of a photoconductive member, space must be secured for the LEDs and a substrate.

Use of optical fibers may provide solutions to these problems with the prior art techniques. More specifically, in order to solve the problem a), a single light source 104 such as a lamp for electric charge removing is mounted and an optical fiber 201 is disposed such that it runs along specified portions of the photoconductive member 101 from the light source 104 as shown in FIG. 5. Formed on the outer peripheral surface of the optical fiber 201 on the opposite side to the photoconductive member 101 are a diffusion area extending along the longitudinal direction of the optical fiber 201 and a reflection area exterior to the diffusion portion. In such an arrangement, rays of light (L) from the light source 104 are reflected or diffused in the radial direction of the optical fiber 201 so that the specified portions of the photoconductive member 101 are illuminated for optically removing residual electric charges (see S62-127786).

In such a configuration, the single light source 104 applies the light L to the photoconductive member 101 through the optical fiber 201. The use of the configuration, however, increases component part costs to a great extent because optical fibers are relatively expensive. Moreover, since the optical fiber 201, when used as it is, is unable to diverge the light L toward the specified portions, the configuration in point has the disadvantage of lacking in latitude with respect to the guiding of the light L of the light source 104 toward the specified portions.

Also, for the problem b), it may be considered that a simplified apparatus configuration is accomplished by making utilization of an optical fiber so as to guide light rays from a single LED unit toward a plurality of photoconductive members. However, such arrangement is difficult to make for the same reason as described previously, and is costly.

To solve both the problem a) and the problem b), a waveguide member capable of easily achieving divergence, refraction, and transmission of light rays is required. By the use of such a waveguide member, it becomes possible to reduce the number of light sources required and, further, as for the problem a), it is possible to evenly apply light rays across the entire width of a photoconductive member.

SUMMARY OF THE INVENTION

Accordingly, a general object of the present invention is to provide solutions to the above-described problems.

Another object of the present invention is to provide a waveguide member (a light propagation member) capable of easily achieving divergence and/or refraction of light rays.

Still another object of the present invention is to provide a simplified configuration to an image forming apparatus having a photoconductive member.

A further object of the present invention is to provide a waveguide member capable of evenly apply light rays across the entire width of a photoconductive member.

A still further object of the present invention is to provide a light charge-removing unit capable of reducing the number of light sources for illuminating photoconductive members.

Another object of the present invention is to provide a light-quantity control device capable of performing control so that the light quantity of a light source for illuminating a photoconductive member is set to a desired value.

These and other objects are attained by an image forming apparatus of the present invention, the image forming apparatus comprising:

a plurality of photoconductive members on which images are formed according to the principle of electrophotography technology;

a light source; and a waveguide member including a body portion where rays of light from the light source enter and a divergence portion by which the light rays from the light source are made to branch off from the body portion and are guided to the plurality of photoconductive members.

Further, the object of the present invention is attained by a light charge-removing unit which is incorporated in an image forming apparatus having a plurality of photoconductive members and which is operable to remove electric charges from posterior-to-transfer/prior-to-charge areas of the plurality of photoconductive members by subjecting the plurality of photoconductive members to exposure to light, the light charge-removing unit comprising:

a light source common to all of the plurality of photoconductive members; and a waveguide member of guiding rays of light from the light source to each of the plurality of photoconductive members;

wherein the waveguide member includes a divergence portion by which the light rays emitted from the light source are made to branch off; and wherein the light rays diverged in the divergence portion fall on the plurality of photoconductive members.

Further, the object of the present invention is attained by an image forming apparatus, the image forming apparatus comprising:

a photoconductive member on which an image is formed;

a single light source for optically removing residual electric charges remaining in the photoconductive member;

a waveguide member for guiding rays of light from the light source to illumination points so as to illuminate the photoconductive member;

a sensor which receives a part of the light rays from the light source through the waveguide member; and a light-quantity controller for controlling, according to the amount of light received by the sensor, the light-emission amount of the light source;

wherein a plurality of the photoconductive members are provided.

The object of the present invention is attained by a light-quantity control device, the light-quantity control device comprising:

a light source which is incorporated in an image forming apparatus having a plurality of photoconductive members and which emits light rays to simultaneously illuminate the plurality of photoconductive members;

a sensor which receives light from the light source; and a controller for varying the light-emission amount of the light source according to detection by the sensor.

The invention itself, together with further objects and attendant advantages, will best be understood by reference to the following detailed description taken in conjunction with accompanying drawings.

BRIEF DESCRIPTION OF THE DRAWINGS

In the following description, like parts are designated by like reference numbers throughout the several drawing figures.

DESCRIPTION OF THE PREFERRED EMBODIMENTS

Hereinafter, embodiments of the present invention will be described by reference to the drawings.

Figure 1:
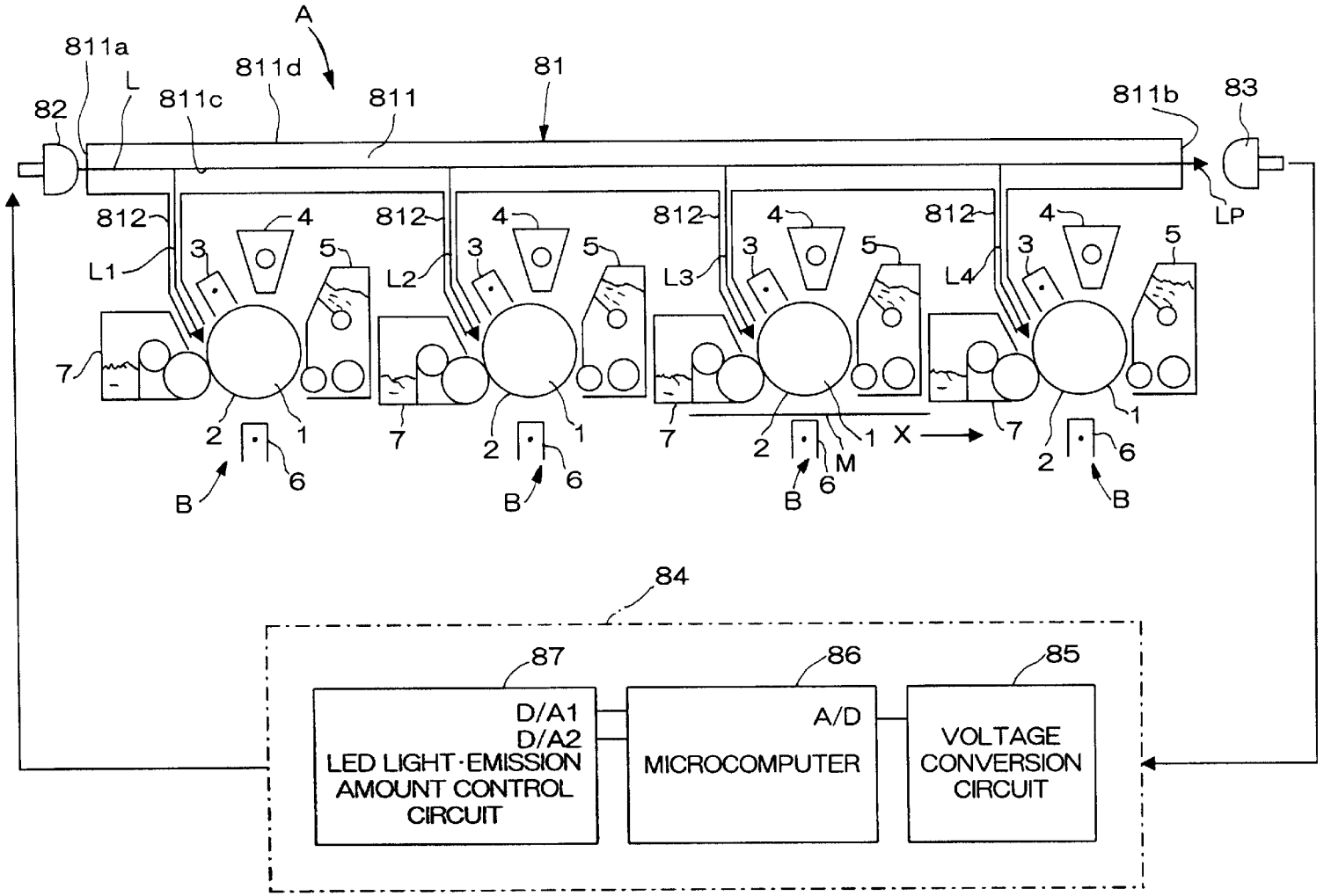
FIG. 1 is a schematic structure diagram illustrating major parts of a photocopier according to an embodiment of the present invention.

Referring first to FIG. 1, there is schematically shown a structure of a full-color photocopier as one example of the image forming apparatus of the present invention.

FIG. 1 shows that a photocopier A has four image forming portions B disposed side by side along the direction in which a copy paper sheet M is fed and conveyed (i.e., the direction X indicated by the arrow). Each of these four image forming portions B comprises a rotational drum 1 which is disposed such that its axial direction is oriented normal to the feed direction of the copy paper sheet M, a photoconductive member 2 which is formed so as to cover the outer peripheral surface of the rotational drum 1, a charger 3 which is arranged in the rotational circumference of the photoconductive member 2, a printing head 4, a developer 5, a transfer device 6, and a cleaner 7. FIG. 1 further shows a light eraser 8.

These four image forming portions B perform an image forming process step for K (black), an image forming process step for M (magenta), an image forming process step for C (cyan), and an image forming process step for Y (yellow), respectively. Prior to recording of image information, each of the photoconductive members 2 of the rotational drums 1 is charged with positive electric charges by the charger 3. The photoconductive member 2 in such a charged state is subjected to exposure to light corresponding to specified image data by the printing head 4, whereby an electric charge pattern corresponding to the image data is formed on the photoconductive member 2 in the form of a latent image.

By the developer 5, specified toner powder particles are adhered to the surface of the photoconductive member 2 according to the electric charge pattern, to form a toner pattern. The toner pattern thus formed is transferred by the transfer device 6 onto the copy paper sheet M and is heated to be fixed thereon. After the transfer process, residual toner powder particles remaining on the photoconductive member 2 are removed therefrom by the cleaner 7. Further, residual electric charges remaining in the photoconductive member 2 are removed by the light eraser 8. These process steps are continuously carried out with the rotation of the rotational drum 1.

The light eraser 8 includes an LED (Light-Emitting Diode) unit 82, a photodiode (hereinafter called the PD) 83, and a light-quantity control portion 84. The LED unit 82 has, in the direction perpendicular to the face of the copy paper sheet, a plurality of LEDs disposed along a length equal to the width of the photoconductive member 2. The LED unit 82 applies light from the LEDs to the photoconductive member 2, to optically remove residual electric charges remaining on the photoconductive member 2. The PD 83 receives light from the LED unit 82 through a lightguide plate 81. The PD 83, therefore, has the same length as the LED unit 82 in the direction perpendicular to face of the copy paper sheet. In response to an output from the PD 83, the light-quantity control portion 84 controls the light-emission amount of the LED 82.

The lightguide plate 81 has, at upper parts of the image forming portion B, a lightguide plate body portion 811 and a divergence portion 812. The lightguide plate body portion 811 has a cross section of a rectangular shape elongating in the axial direction of the rotational drum 1 and is disposed in the direction in which the image forming portions B are arranged side by side. The divergence portion 812 diverges from a face 811*c* of the lightguide plate body portion 811 on the side of the image forming portion B and has an endmost face which is located between the cleaner 7 and the charger 3 so as to face the photoconductive member 2. The divergence portion 812 is formed, in cross section, into a rectangular shape having a length covering that of the photoconductive member 2.

The LED unit 82 is arranged, with respect to the horizontal direction of the copy paper sheet face, in close proximity to one end face (811*a*) of the lightguide plate body portion 811. On the other hand, the PD 83 is arranged, with respect to the horizontal direction of the copy paper sheet face, in close proximity to the other end surface (811*b*) of the lightguide plate body portion 811. As a result of such arrangement, a first part of light L from the LED unit 82 incident on the end face 811*a* of the lightguide plate body portion 811 branches off into each divergence portion 812, and a second part of the light L travels straight through the lightguide plate body portion 811, is radiated from the end surface 811*b* of the lightguide plate body portion 811, and is received by the PD 83.

Light rays L1–L4, branched off into the divergence portions 812, respectively, are transmitted along the longitudinal direction of the divergence portions 812. Thereafter, each light ray L1–L4 is applied from the endmost face of the divergence portion 812 to the photoconductive member 2 at a luminous flux corresponding in length and width to the endmost face of the divergence portion 812. As a result, each of the photoconductive members 2 is optically discharged.

The divergence of light rays to the divergence portions 812 may be made by forming, at a specified position of the lightguide plate 81, a reflection or refraction portion capable of reflecting or refracting the light L from the LED unit 82 to the divergence portions 812. For example, for the light L from the LED unit 82 to be reflected in the directions of the divergence portions 812, a side face 811*d* of the lightguide plate body portion 811 on the side opposite to the divergence portions 812 (i.e., the upper face of the lightguide plate body portion 811 of FIG. 1) is formed into a tapered face which inclines so that the lightguide plate body portion 811 continuously decreases in its thickness or height as it extends from the end face 811*a* to the end face 811*b*. Further, an arrangement may be made in which a reflection portion is formed all over the side face 811*d* or at a certain area of the side face 811*d* facing the divergence portion, by affixation of reflection tape or vapor deposition of aluminum in order that the light L is reflected to each of the divergence portions 812 with high efficiency. Alternatively, another arrangement may be made in which areas of the side face 811*d* other than the area thereof that faces the divergence portion are coarsened for the purpose of diffusing light rays toward the divergence portions 812. In addition, such a step that diverges the light L incident on the end face 811*a* of the lightguide plate body portion 811 toward the divergence portions 812 with high efficiency may be taken as the need arises.

As described above, the PD 83 receives a part of the light L emanating from the LED unit 82 that travels straight in the longitudinal direction of the lightguide plate body portion 811. As the light quantity of the light rays L1–L4 which diverge to the divergence portions 812 decreases, the quantity (Lp) of light entering the PD 83 likewise decreases. Therefore it becomes possible to perform control so that the light quantity of the illumination light rays L1–L4 for the photoconductive members 2 is set to a fixed value required for the removal of electric charges, by detecting an output from the PD 83.

The light-quantity control portion 84 has a voltage conversion circuit 85, a microcomputer 86, and an LED light-emission amount control circuit 87. The voltage conversion circuit 85 functions to convert an output from the PD 83 into a voltage. The microcomputer 86 receives an output from the voltage conversion circuit 85 and A/D converts same for comparison with a reference value, thereby to generate a signal used to control the light-emission amount of the LED unit 82. The LED light-emission amount control circuit 87 functions to control, based on an output from the microcomputer 86, the light-emission amount of the LED unit 82.

The microcomputer 86 has an analog input port AD and two digital output ports DA1 and DA2. Each of the digital output ports DA1 and DA2 is set at eight bits (variable from 0 to 255, i.e., 256 value levels). The total of output values from these two digital output ports DA1 and DA2 (from 0 to 510) is used for the controlling of the light-emission amount of the LED unit 82. The output value of the PD 83 is used for comparison/decision with respect to the light-emission reference value of the LED unit 82.

In the present embodiment, the LED unit 82, made up of LEDs arranged side by side in the photoconductive member crosswise direction (i.e., the copy paper sheet face vertical direction), is employed as a light source common to the four photoconductive members, which, however, should not be considered restrictive in any way. As a light source common to a plurality of photoconductive members, halogen lamps each running the photoconductive member crosswise direction may be employed. Further, in the present embodiment, the light-guide plate is employed as a lightguide member for guiding light rays from the common light source to each photoconductive member, which, however, should not be considered restrictive in any way. As a member for guiding light, for example, a bundle of optical fibers may be employed. In other words, it suffices that a part of light rays from a light source common to a plurality of photoconductive members are guided to the photoconductive members. Further, it suffices that the remaining part of the light rays from the light source is guided to the PD.

Next, the operation of the light-quantity control portion 84 will be described below with reference to a flowchart diagram of FIG. 2.

Figure 2:
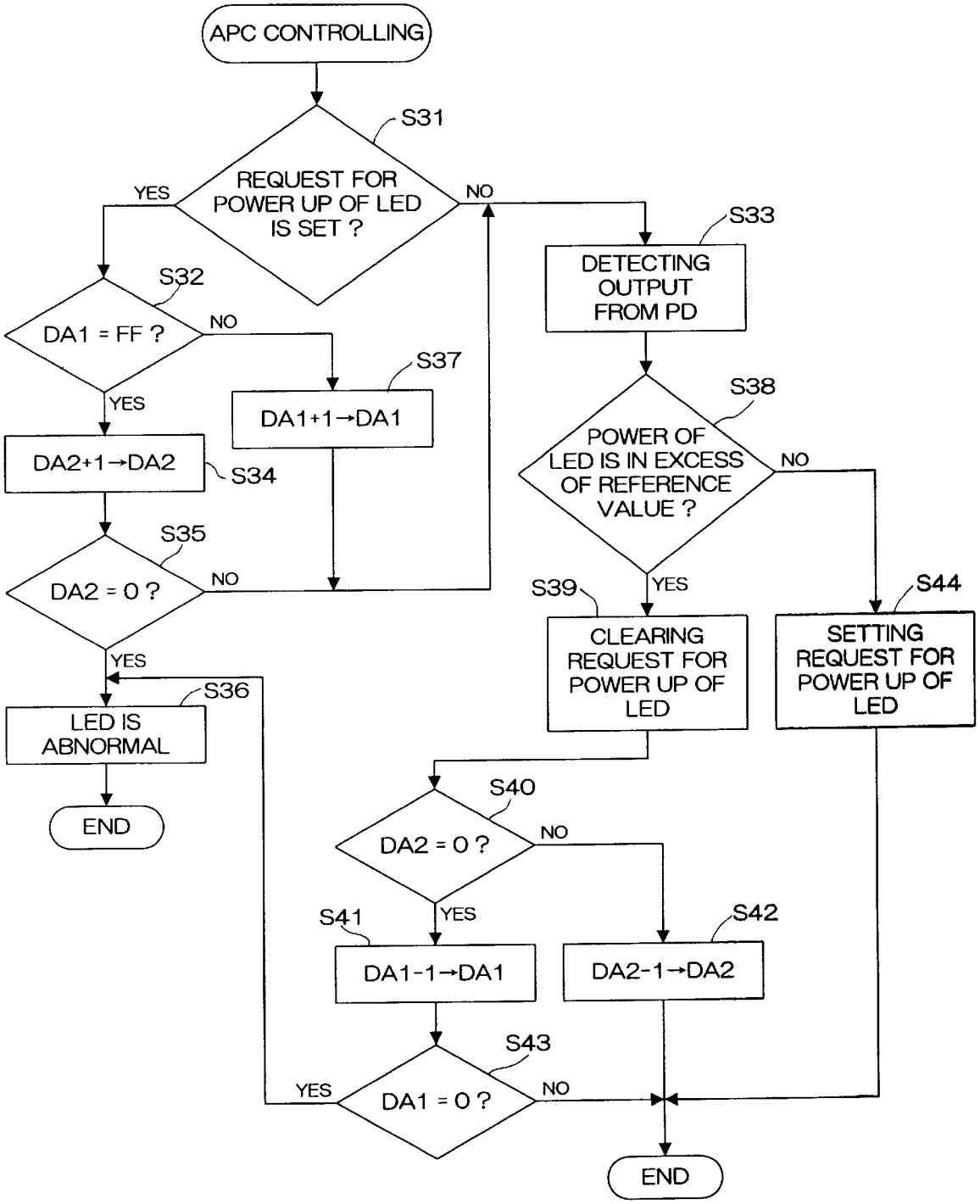
FIG. 2 is a flowchart diagram showing a light-quantity control procedure in a light eraser of the photocopier of FIG. 1.

In FIG. 2 as well as in the following description, S denotes a step. In the following description, increasing the light-emission amount of the LED unit 82 is referred to as power up.

Referring to FIG. 2, at S31 the microcomputer 86 first determines whether a request for the power up of the LED unit 82 is set.

If no LED power up request is set (i.e., the "NO" branch from S31), an output from the PD 83 is detected at S33. On the other hand, if the request is set (i.e., the "YES" branch from S31), it is determined at S32 whether the value of the output port DA1 of the microcomputer 86 (from 0 to 255) amounts to FF, i.e., the upper limit (255).

If the value of the output port DA1 of the microcomputer 86 is at its upper limit (255) at S32 (i.e., the "YES" branch from S32), it is impossible to further increase the value of the output port DA1. Accordingly, the microcomputer 86 adds to the value of the output port DA2 (0–255) one (one value level which is the control minimum unit amount) at S34. This is made to serve as a set value of the output port DA2 and, thereafter, it is determined at S35 whether the value of the output port DA2 is zero. If the value of the output port DA2 is zero in spite of the addition of one to the value of the output port DA2 at S34 (i.e., the "YES" branch from S35), it is then considered that the LED unit 82 is in an abnormal condition. The abnormal processing of the LED unit 82 is carried out and the control routine is terminated. On the other hand, if the value of the output port DA2 is not zero (i.e., the "NO" branch from S35), the control routine advances to S33.

If a decision result of S32 shows that the value of the output port DA1 is not at its upper limit (255) (i.e., the "NO" branch from S32), this indicates that there is a margin for the value of the output port DA1 to be increased. Therefore, one is added to the value of the output port DA1 at S37. This is made to serve as a set value of the output port DA1 and the control routine advances to S33.

After having detected an output from the PD 83 at S33, the microcomputer 86 determines, at S38, whether the output value of the PD 83 exceeds a reference value, in other words the microcomputer 86 determines whether the power of the LED unit 82 exceeds the reference value. If the power of the LED unit 82 is in excess of the reference value (i.e., the "YES" branch from S38), then the request for the power up of the LED unit 82 is cleared at S39. It is then determined at S40 whether the value of the output port DA2 is zero. In other words, it is determined whether the total of output values of the output ports DA1 and DA2 exceeds the upper limit of the output port DA1 (255).

If the value of the output port DA2 is zero (i.e., the "NO" branch from S40), this indicates that the value of the output port DA1 is not in excess of the upper limit. Accordingly, it is possible to perform power reduction control of the LED unit 82 by changing the value of the output port DA1. Accordingly, at S41 one is subtracted from the value of the output port DA1 and the result is made to serve as a set value of the output port DA1. Subsequently, it is determined at S43 whether the value of the output port DA1 is zero. If the value of the output port DA1 is zero (i.e., the "YES" branch from S43), this indicates that the LED unit 82 is in an abnormal condition, and the control routine advances to LED abnormal processing of S36. On the other hand, if the value of the output port DA1 is not zero (i.e., the "NO" branch from S43), this indicates that the LED unit 82 is in a normal condition. Then, the control routine is terminated.

If a decision result of S40 shows that the value of the output port DA2 is not zero (i.e., the "NO" branch from S40), this indicates that the value of the output port DA1 have amounted to the upper limit (255) and there is need for power reduction control by manipulating the value of the output port DA2. One is therefore subtracted from the value of the output port DA2 at S42 and the result is made to serve as a set value of the output port DA2. This is followed by termination of the control routine.

On the other hand, if a decision result of S38 shows that the power of the LED unit 82 falls below the reference value (i.e., the "NO" branch from S38), a request for the power up of the LED unit 82 is set at S44. The control routine is terminated and, thereafter, is again repeated. Then the light-emission amount of the LED unit 82 (i.e., the detected output amount of the PD 83) amounts to above the reference value and, when the fact that the LED light-emission amount exceeds the reference value is confirmed, the LED power up request is cleared. Then the total of output values of the output ports DA1 and DA2 of the microcomputer 86 is set to a value lower by one than the reference value.

In the way as described above, the output value total of the output ports DA1 and DA2 is set to a value which is lower by one than the reference value even when automatic light-quantity control of the LED unit 82 is started from any condition. As a result, the light-emission amount is kept at a fixed value. In other words, the illumination amounts L1–L4 to the photoconductive members 2 are controlled at a desired value for each photoconductive member.

The present invention embodied as shown in FIGS. 1 and 2 is applied to the full-color photocopier A having the image forming portions B. The present invention is also applicable to an image forming apparatus having only one image forming portion (photoconductive member), as shown in FIG. 3.

Figure 3:
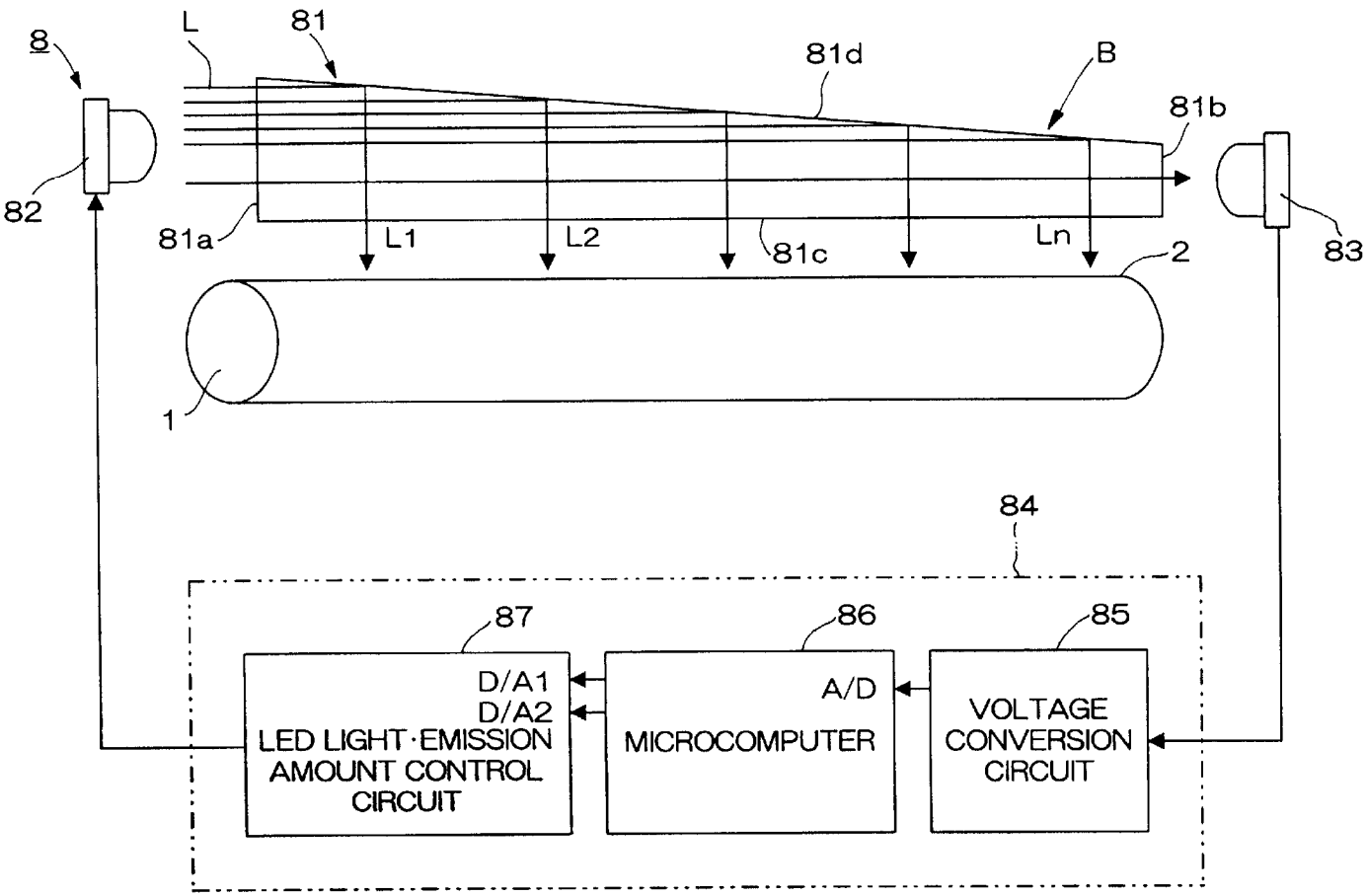
FIG. 3 is a schematic structure diagram illustrating major parts of a photocopier according to another embodiment of the present invention.
Figure 4:
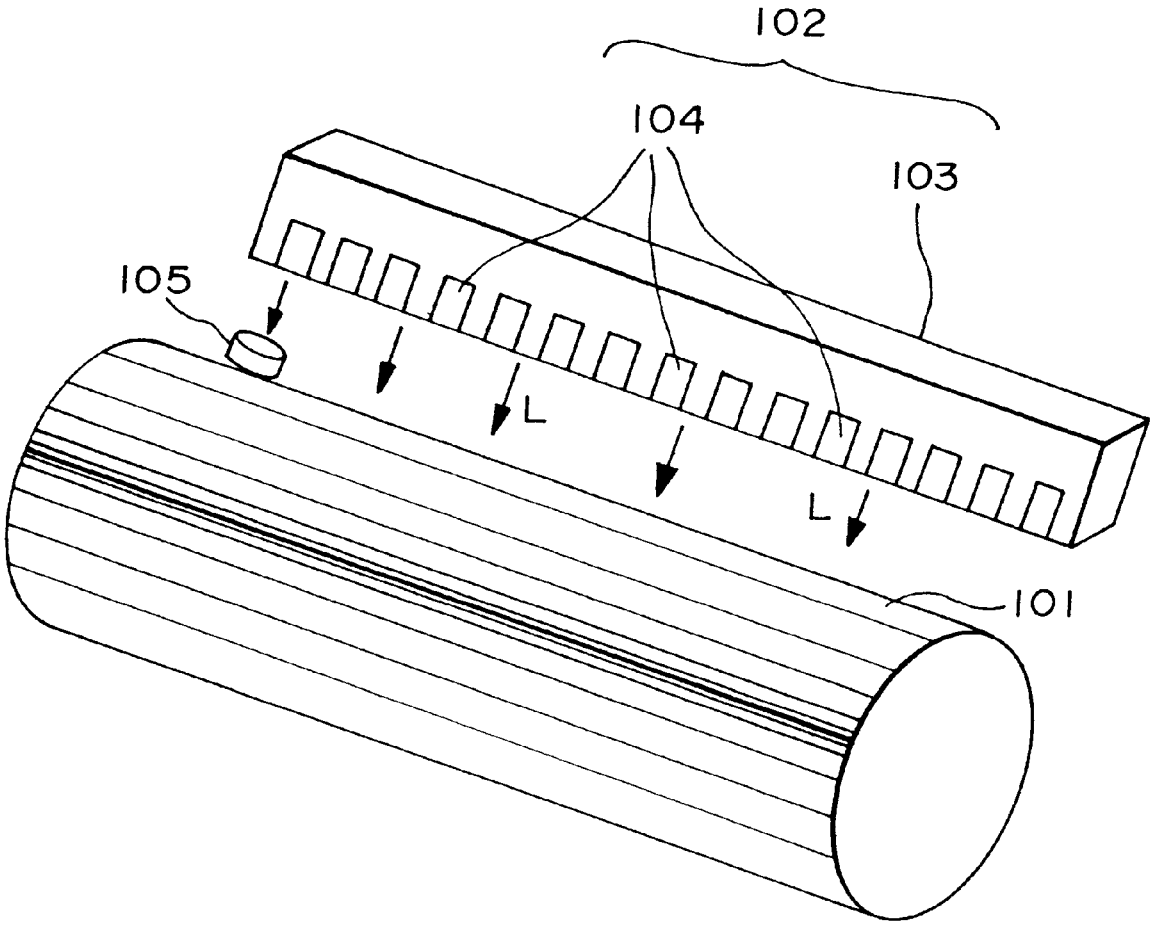
Fig.4 PRIOR ART
FIG. 4 is a perspective diagram illustrating a structure of a light eraser of a prior art image forming apparatus.
Figure 5:
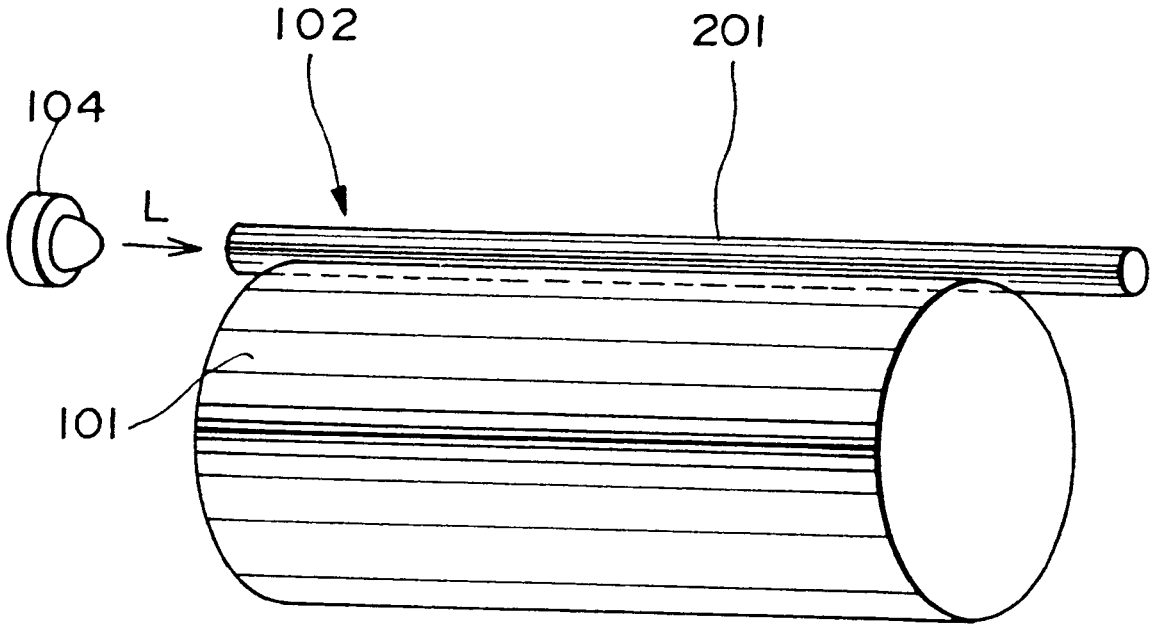
Fig.5 PRIOR ART
FIG. 5 is a perspective diagram illustrating a structure of a light eraser of another prior art image forming apparatus.

FIG. 3 shows a rotational drum 1, a photoconductive member 2 applied around the circumferential surface of the rotational drum 1, and a light eraser 8. The light eraser 8 has a lightguide plate 81 extending along the longitudinal direction of the rotation drum 1, an LED 82 as a single light source disposed in close proximity to one end face 81*a* of the lightguide plate 81 with respect to the longitudinal direction thereof, a PD 83 as a light receiving means disposed in close proximity to the other end face 81*b* of the lightguide plate 81 with respect to the longitudinal direction thereof, and a light-quantity light control portion 84 which receives an output from the PD 83 and which controls the light quantity of the LED 82.

The lightguide plate 81 is formed of acrylic resin, having a length corresponding to that of the photoconductive member 2. Further, the lightguide plate 81 is formed in cross section into a rectangular shape which elongates in the radial direction of the photoconductive member 2, wherein one side face 81*c* of the lightguide plate 81 (i.e., a lower face of the lightguide plate 81 in FIG. 3) on the side of the photoconductive member 2 is oriented face to face with the photoconductive member 2. Moreover, in order to form light rays L1–Ln for illuminating the photoconductive member 2 by reflecting light rays incident from the LED 82 in the direction of the photoconductive member 2, the other side face 81*d* of the lightguide plate 81 on the opposite side to the photoconductive member 2 is formed into a tapered face which inclines so that the cross-sectional length of the lightguide plate 81 continuously decreases as it extends from the end face 81*a* to the end face 81*b* with respect to the longitudinal direction. The tapered face 81*d* may be formed into a reflection face by aluminum vapor deposition or by affixation of reflection tape.

The LED 82, the PD 83, and the light-quantity control portion 24 are identical in configuration and operation with the embodiment shown in FIGS. 1 and 2.

In the embodiment shown in FIG. 3, the light L, emitted from the LED 82 to enter one end of the lightguide plate 81 with respect to the longitudinal direction, is reflected by the upper side face 81*d* of the lightguide plate 81 which is a tapered face, toward the rotational drum 1, thereby becoming light rays L1–Ln which are then applied from the side face 81*c* of the lightguide plate 81 on the photoconductive member side to the photoconductive member 2 of the rotational drum 1. On the other hand, a part of the light L from the LED 82 travels straight through the lightguide plate 81 to the PD 83 at which the light L is received. As in the embodiment shown in FIGS. 1 and 2, the light-quantity control portion 84 performs control according to the quantity of light received by the PD 83 so that the light-emission amount of the LED 82 is kept at a fixed value. In the way described above, the quantity of light for illumination of the photoconductive member 2 is kept at a fixed value, whereby stable electric charge removal can be carried out.

In the foregoing embodiments, the description has been made in which the microcomputer 86 of the light-quantity control means 24 has the two 8-bit digital output ports DA1 and DA2. A microcomputer of a different type may be used which has a different number of bits and a different number of output ports.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a plurality of photoconductive members on each of which an electrostatic latent image is formed;

a light source for emitting light rays; and a waveguide member including a body portion where the emitted light rays enter and a divergence portion by which the emitted light rays are made to branch off from the body portion and are guided to the plurality of photoconductive member, wherein the photoconductive members are illuminated with the light rays, emitted from the light source and passed through the divergence portion, so that the photoconductive members are discharged, and the body portion tapers along the incident direction of the light rays from the light source.

2. An image forming apparatus comprising:

a plurality of photoconductive members on each of which an electrostatic latent image is formed;

a light source for emitting light rays; and a waveguide member including a body portion where the emitted light rays enter and a divergence portion by which the emitted light rays are made to branch off from the body portion and are guided to the plurality of photoconductive member, wherein the photoconductive members are illuminated with the light rays, emitted from the light source and passed through the divergence portion, so that the photoconductive members are discharged, and the body portion has a reflection portion located face to face with the divergence portion.

* * * * *